US007893631B2

(12) United States Patent
Speier

(10) Patent No.: US 7,893,631 B2
(45) Date of Patent: Feb. 22, 2011

(54) WHITE LIGHT LUMINAIRE WITH ADJUSTABLE CORRELATED COLOUR TEMPERATURE

(75) Inventor: Ingo Speier, Saanichton (CA)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/583,297

(22) PCT Filed: Apr. 6, 2006

(86) PCT No.: PCT/CA2006/000507

§ 371 (c)(1),
(2), (4) Date: Aug. 14, 2008

(87) PCT Pub. No.: WO2006/105649

PCT Pub. Date: Oct. 12, 2006

(65) Prior Publication Data

US 2008/0297054 A1 Dec. 4, 2008

Related U.S. Application Data

(60) Provisional application No. 60/669,047, filed on Apr. 6, 2005.

(51) Int. Cl.
*G05F 1/00* (2006.01)
*H01J 31/26* (2006.01)

(52) U.S. Cl. ..... 315/308; 315/112

(58) Field of Classification Search ..... 315/149, 315/118, 117, 308, 309, 7; 362/800, 7
See application file for complete search history.

(56) References Cited

U.S. PATENT DOCUMENTS

| | | | | |
|---|---|---|---|---|
| 5,384,519 | A * | 1/1995 | Gotoh | 315/324 |
| 6,153,971 | A * | 11/2000 | Shimizu et al. | 313/486 |
| 6,224,240 | B1 * | 5/2001 | Shimizu et al. | 362/260 |
| 6,441,558 | B1 * | 8/2002 | Muthu et al. | 315/149 |
| 6,488,390 | B1 * | 12/2002 | Lebens et al. | 362/231 |
| 6,507,159 | B2 * | 1/2003 | Muthu | 315/307 |
| 6,630,801 | B2 * | 10/2003 | Schuurmans | 315/307 |
| 6,670,987 | B1 * | 12/2003 | Taura | 348/223.1 |
| 6,805,600 | B2 * | 10/2004 | Wang et al. | 445/24 |
| 6,858,869 | B2 | 2/2005 | Fujiwara | |
| 7,071,616 | B2 * | 7/2006 | Shimizu et al. | 313/506 |

(Continued)

FOREIGN PATENT DOCUMENTS

JP 2002/270899 9/2002

OTHER PUBLICATIONS

Commission Internationale de I Eclairage (CIE) 15 (2004) pp. 2-27.

(Continued)

*Primary Examiner*—Douglas W Owens
*Assistant Examiner*—Minh D A

(57) ABSTRACT

The present invention provides a luminaire system and method for creating white light having a desired color temperature. The system comprises one or more white light light-emitting elements for generating white light having a particular color temperature. The system further comprises one or more first color light-emitting elements and one or more second color light-emitting elements. The luminaire system mixes the colored light generated by the first and second color light-emitting elements with the white light of a particular color temperature, in order to create white light having a desired correlated color temperature.

21 Claims, 6 Drawing Sheets

U.S. PATENT DOCUMENTS

2002/0048177 A1 4/2002 Rahm et al.
2002/0097000 A1 * 7/2002 Muthu et al. ..... 315/169.3
2003/0107887 A1 6/2003 Eberl
2004/0052076 A1 3/2004 Mueller et al.
2005/0030744 A1 2/2005 Ducharme et al.

OTHER PUBLICATIONS

Commission Internationale de I Eclairage (CIE) 15 (2004) pp. 36-38.

* cited by examiner

WHITE LIGHT LUMINAIRE WITH ADJUSTABLE CORRELATED COLOUR TEMPERATURE

FIELD OF THE INVENTION

The present invention pertains to white light luminaries and more specifically to a system for providing white light with selectable correlated colour temperature.

BACKGROUND

Within the past few years light-emitting diode (LED) technology has advanced to a point where the efficiency of light generated by an LED array matches or even exceeds the efficiency of incandescent lamps. In many lighting applications, red, green and blue LEDs are employed to generate a conventional white light. By properly mixing the light generated by each group of the red, green and blue LEDs it is possible to control the colour temperature of the white light generated by the LEDs. Theoretically, the colour temperature of a light source is defined in terms of the temperature of an ideal purely thermal light source also known as a Planck or black body radiator whose emitted light spectrum has the same chromaticity as that of the light source. The colour temperature is typically measured in Kelvin because a black body at that temperature emits a light spectrum of that specific chromaticity. Even when the chromaticity or the colour temperature is the same, the light source and the black body radiator may have different spectral density distributions which may lead to differences in the observable colour rendering. A measure for this deviation can be defined in terms of a colour rendering index which defines how well colours are rendered by different light sources in comparison to a reference standard.

The term chromaticity is applied to identify the colour of the light source regardless of its brightness or luminance. Brightness or luminance is typically measured in candela/$cm^2$. When the chromaticity of different light sources is equal, the colour of the light from each light source is most likely to appear the same to the eye of a human standard observer regardless of the lighting level. The chromaticity of a light source can be represented by chromaticity coordinates. An example of such coordinates is the CIE (Commission Internationale de l'Eclairage) 1931 chromaticity diagram, in which the colour of the emitted light is represented by x and y coordinates.

Having regard to LED based luminaries, the energy efficiency, overall system effectiveness, colour uniformity, colour rendering, and economic viability of a white light generating luminaire can greatly depend on the specific characteristics of the kinds of LEDs which are employed as light sources in the colour mixing process preformed by the luminaire.

United States Patent Application No. 2005/0030744 discloses a white light LED luminaire system comprising two white light LED sources of different correlated colour temperature. The system can generate variable colour temperature white light when mixed with an additional colour, for example, amber. This invention however, is based on a relatively inefficient utilization of two different colour temperature white light LED sources because each white light source must be dimmed considerably under almost all operational conditions in order to achieve a desired intermediate correlated colour temperature white light emission. Consequently, the luminaire of this system can require approximately twice as many white light LED sources to create a desired colour temperature white light impression than may otherwise be necessary.

Thus, there is a need for a luminaire system that can effectively combine a reduced number of light sources that can maintain a specified, and in particular, an adjustable correlated colour temperature at a desired brightness for required operating conditions.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a white light luminaire with adjustable correlated colour temperature. In accordance with an aspect of the present invention, there is provided a luminaire system for generating white light with a desired correlated colour temperature, the luminaire system comprising: a light module including: one or more white light-emitting elements for generating white light having a particular correlated colour temperature; one or more first colour light-emitting elements for generating light of a first colour; one or more second colour light-emitting elements for generating light of a second colour; a feedback system for collecting operational temperature information regarding the light module; a drive and control system for receiving said temperature information, and controlling the supply of power to each of the one or more white light-emitting elements, the one or more first colour light-emitting elements, and the one or more second colour light-emitting elements based on the temperature information and the desired correlated colour temperature; and an optical system for extracting and mixing the light generated by the light module thereby creating an output beam having the desired correlated colour temperature.

In accordance with another aspect of the invention, there is provided a method for generating mixed white light having a desired correlated colour temperature, the method comprising: generating white light having a particular correlated colour temperature by one or more white light-emitting elements; generating and mixing in a predetermined portion of light generated by one or more first colour light-emitting elements; and generating and mixing in a predetermined portion of light generated by one or more second colour light-emitting elements; thereby generating mixed white light having the desired correlated colour temperature.

DETAILED DESCRIPTION OF THE INVENTION

Definitions

Figure 1:
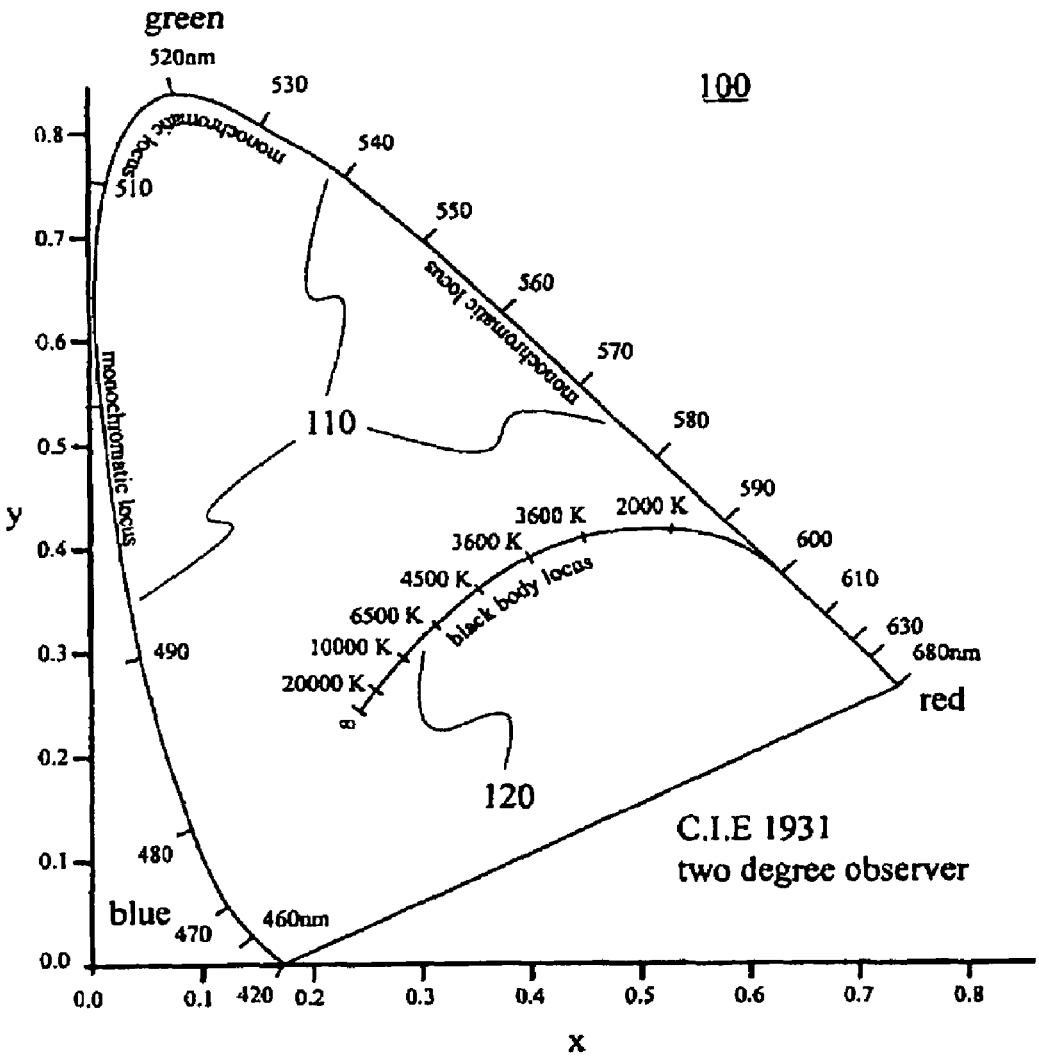
FIG. 1 illustrates a chromaticity diagram according to the CIE 1931 two degree observer standard.

The term "light-emitting element" is used to define any device that emits radiation in any region or combination of regions of the electromagnetic spectrum for example, the visible region, infra and/or ultraviolet region, when activated by applying a potential difference across it or passing a current through it, for example. Therefore a light-emitting element can have monochromatic, quasi-monochromatic, polychromatic or broadband spectral emission characteristics. Examples of light-emitting elements include semiconductor, organic, or polymer/polymeric light-emitting diodes, optically pumped phosphor coated light-emitting diodes, optically pumped nano-crystal light-emitting diodes or any other similar light-emitting devices as would be readily understood by a worker skilled in the art. Furthermore, the term light-emitting element is used to define the specific device that emits the radiation, for example a LED die, and can equally be used to define a combination of the specific device that emits the radiation together with a housing or package within which the specific device or devices are placed.

The term "chromaticity" is used to define the perceived colour impression of light according to standards of the Commission Internationale de l'Eclairage.

The term "luminous flux output" is used to define the quantity of luminous flux emitted by a light source according to standards of the Commission Internationale de l'Eclairage.

The term "gamut" is used to define the plurality of chromaticity values that a light source is able to achieve.

The terms "colour temperature" and "correlated colour temperature (CCT)" are used interchangeably to define the temperature of a physical light source whose perceived colour most closely resembles that of an ideal Planckian light source at the same brightness and under specified viewing conditions.

As used herein, the term "about" refers to a +/−10% variation from the nominal value. It is to be understood that such a variation is always included in any given value provided herein, whether or not it is specifically referred to.

Unless defined otherwise, all technical and scientific terms used herein have the same meaning as commonly understood by one of ordinary skill in the art to which this invention belongs.

The present invention provides a luminaire system and method for creating white light having a desired colour temperature. The luminaire system comprises a light module formed from one or more white-light light-emitting elements for generating white light having a particular colour temperature. The luminaire system further comprises one or more first colour light-emitting elements and one or more second colour light-emitting elements. The luminaire system mixes the coloured light generated by the first and second colour light-emitting elements with the white light of the particular colour temperature, in order to create white light having a desired correlated colour temperature.

The luminaire system according to the present invention comprises a light module including a primary light source of white-light light-emitting elements or an array of light-emitting elements for creating white light, such that the generated white light has a predetermined correlated colour temperature. The primary light source can be operated at substantially optimal operating conditions such that adjusting the luminous flux output of the primary light source may not be required to achieve a desired range of colour temperature.

The light source further comprises two or more secondary light sources that emit light having a first colour and a second colour. Optionally, a secondary light source emitting light having a third colour may further be integrated into the luminaire system. The first and second colour secondary light sources provide for the adjustment of the correlated colour temperature of the total luminous flux output of the luminaire system.

Light Sources

The lighting module of the luminaire system according to the present invention comprises three or more light sources having different chromaticities. The light module comprises a primary light source and two or more secondary light sources. The primary light source generates the substantially white light having a correlated colour temperature and the secondary light sources provide for the adjustment of the correlated colour temperature of the white light generated by the luminaire system.

In one embodiment, the characteristics of the white, first colour, and second colour light-emitting elements for the luminaire system may be chosen such that a minimum number of light-emitting elements can generate a substantially maximum variation of correlated colour temperature at a substantially minimum luminous flux output variation, while substantially minimizing the adjust of the luminous flux output of the white light-emitting elements. For example, by selecting certain blue and green light-emitting elements together with white light-emitting elements of about 2900K CCT, the spectrum of the light that may be generated by the luminaire system can be shifted between a correlated colour temperature of about 2900K and about 4100K with a luminous flux output variation of less than about 15%.

In one embodiment of the present invention the luminaire system comprises light-emitting elements based on the same material technology, for example, InGaN based light-emitting elements. By including light-emitting elements of the same material technology, the required complexity of a control system for controlling the operation of the light-emitting elements may be reduced. For example, light-emitting elements based on a single material technology can have similar colour and luminous flux output temperature dependence. Additionally devices of the same material technology can exhibit similar degradation due to ageing.

In one embodiment, the primary light source comprises one or more white light light-emitting elements. The white light light-emitting elements can be based on variety of different technologies. White light-emitting elements can be based on any kind of electro-optical conversion process and can additionally employ optical-optical conversion processes, for example up-conversion of low-energy long wavelength light or down-conversion of high-energy short wavelength light in order to generate light in the visible range of the electromagnetic spectrum. Examples of these optical-optical conversion light-emitting elements are blue and ultra violet light-emitting element pumped single, dual, tri, or multi-phosphor, quantum dot, or other optical conversion system based light-emitting elements. Commercially available whites light-emitting elements of this configuration include Lumileds Luxeon™ phosphor-coated white light LEDs that incorporate blue-emitting LEDs and yellow and optionally red down-conversion phosphors.

In one embodiment, the light module comprises one or more blue and one or more green LEDs which are used as the secondary light-emitting elements. In another embodiment the light module comprises one or more red and one or more green LEDs used as the secondary light-emitting elements. In the instance of three different coloured secondary light-emitting elements, the colours may be red, green and blue.

FIG. 1 illustrates a chromaticity diagram 100 according to the CIE 1931 two degree observer standard. Generally, a light source can emit electromagnetic radiation with a monochromatic, narrow band or broadband wavelength spectrum. The spectral flux is described by a spectral power density distribution $p(\lambda)$. The spectral power density distribution specifies how much energy the light source emits at a certain wavelength $\lambda$.

The CIE 1931 two-degree observer standard defines three colour-matching functions $\bar{x}(\lambda)$, $\bar{y}(\lambda)$, and $\bar{z}(\lambda)$, which define how sensitive the eyes of the standard observer are to a certain wavelength $\lambda$. These define the tristimulus vales X, Y, and Z according to:

$$X = \int_0^\infty P(\lambda)\bar{x}(\lambda)d\lambda \qquad (1)$$

$$Y = \int_0^\infty P(\lambda)\bar{y}(\lambda)d\lambda$$

$$Z = \int_0^\infty P(\lambda)\bar{z}(\lambda)d\lambda$$

which can then be used to calculate the chromaticity coordinates x, y, and z according to:

$$x(\lambda) = \frac{\bar{x}(\lambda)}{\bar{x}(\lambda) + \bar{y}(\lambda) + \bar{z}(\lambda)} \qquad (2)$$

$$y(\lambda) = \frac{\bar{y}(\lambda)}{\bar{x}(\lambda) + \bar{y}(\lambda) + \bar{z}(\lambda)}$$

$$z(\lambda) = \frac{\bar{z}(\lambda)}{\bar{x}(\lambda) + \bar{y}(\lambda) + \bar{z}(\lambda)}$$

and where $x+y+z=1$. As the chromaticity coordinates are normalized, the third chromaticity coordinate z can be calculated as $z=1-x-y$ upon the determination of x and y.

FIG. 1 illustrates the spectral locus 110 ranging from long red wavelengths starting at about 680 nm via green to short blue wavelengths at about 420 nm. In addition, the blackbody locus 120 indicates the chromaticity coordinates for a blackbody radiator ranging in colour temperature from about 1000K to infinity. Substantially all chromaticity values of the CIE 1931 two-degree observer standard lie within the area inscribed by the spectral locus and the straight line called the "line of purple", between pure red and pure blue.

When mixed in appropriate amounts, the chromaticity coordinates of the combined light of two independent light sources of different chromaticity coordinates $(x_1,y_1)$ and $(x_2, y_2)$ changes linearly and can assume any value which can be represented in the chromaticity diagram by a straight line between these coordinates. Similarly, light mixed from three or more independent light sources whose chromaticity coordinates define a triangle or any other polygon in the chromaticity diagram can create any colour impression with chromaticity coordinates within the boundary defined by the triangle or the polygon. The colour gamut of a respective luminaire comprising two or more independent light sources of different chromaticity coordinates can be defined in terms of such a line, triangle, or polygon.

In the case of three light sources of different chromaticity, each chromaticity value within the colour gamut can be determined deterministically. In the case of four or more light sources of different chromaticity, the evaluation of a possible chromaticity is unconstrained and therefore each chromaticity within the colour gamut can be achieved through several combinations of the light sources. When the output of four or more different light sources is mixed to generate white light of a desired CCT, an algorithm can be required to determine for example a desired combination of light output from each of the four or more light sources in order to achieve a desired CCT.

The light source of the luminaire system of the present invention requires three or more light sources of different chromaticity coordinates, for example, a light module capable of creating light impressions defined by a triangular or polygon colour gamut. Depending on the selection of the three or more light sources, the triangle or polygon colour gamut inscribes at least a portion of the blackbody locus, thereby providing for the creation of a light impression within the colour temperature range defined by the portion of the blackbody locus inscribed by the colour gamut.

In one embodiment of the present invention, the utilization of white light-emitting elements in conjunction with coloured light-emitting elements as an adjustable white light luminaire can provide a means for an improved colour rendering index (CRI) in comparison to adjustable white light luminaire based on coloured light-emitting elements. For example, a red, green and blue adjustable white light luminaire can exhibit gaps in the spectral distribution and can poorly render amber colours, for example. As a result a red, green and blue adjustable white light luminaire typically achieves CRI levels of 60 and lower. According to one embodiment of the present invention, the utilization of a light sources comprising phosphor white light-emitting elements with a wideband emission spectrum and first and second colour light-emitting elements may not exhibit these gaps in the spectral distribution, may render colours such as amber and may achieve an improved CRI with respect to a white light module defined solely by tri-colour, namely RGB, light-emitting elements, for example.

Figure 2:
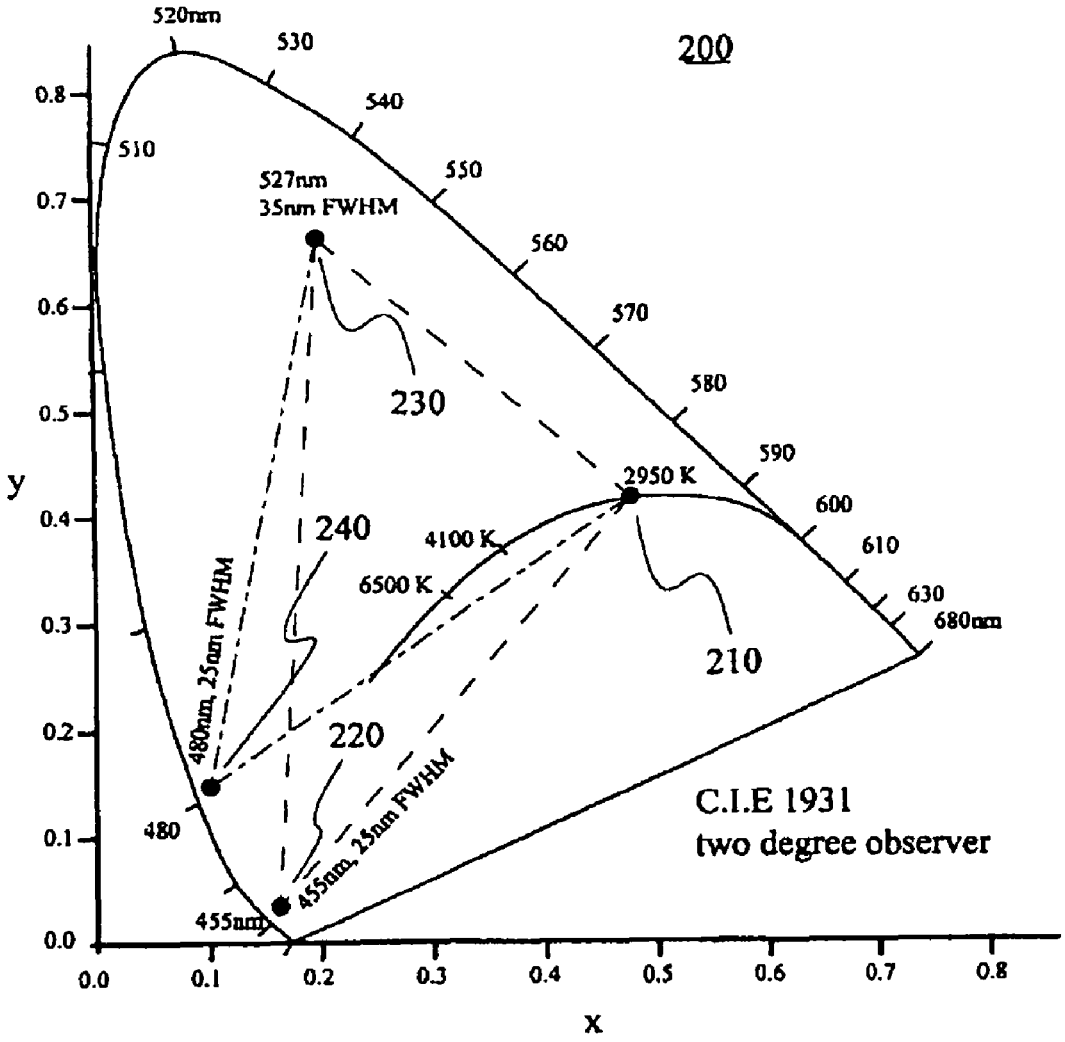
FIG. 2 illustrates the colour gamut and chromaticity diagram for a white light luminaire comprising white, green, and blue light-emitting elements according to one embodiment of the present invention.

FIG. 2 illustrates two colour gamuts of a white light luminaire system in chromaticity diagram 200 according to one embodiment of the present invention, wherein the luminaire system comprises three light sources of substantially different chromaticity. The colour gamuts are indicated by the triangular regions.

In one embodiment, the luminaire system comprises a primary light source of one or more white light light-emitting elements of about 2950K CCT with chromaticity coordinates 210, one or more blue light-emitting element light sources of about 455 nm and about 25 nm FWHM (full width at half maximum) with chromaticity coordinates 220, and one or more green light-emitting element light sources of about 527 nm and about 35 nm FWHM having chromaticity coordinate 230. With this format of light sources the luminaire system can emit white light of any desired CCT up to about 4100K along the black body locus. For example, if about a 200 lumen white light source of about 2950K CCT is mixed with up to about 100 milliwatts or the equivalent of about 3 lumens of the above specified blue light source, and up to about 80 milliwatts or the equivalent of about 50 lumens of the above specified green light source, the luminaire system can have about a 25% overall luminous flux output variation when generating white light having a CCT range between about 2950K to about 4100K.

In one embodiment, the luminaire system with the above defined light source can also be adjusted to emit white light of up to about 6500K using up to about 300 milliwatts or the equivalent of about 9 lumens of the above specified blue light source, and up to about 200 milliwatts or the equivalent of about 120 lumens of the above specified green light source. In this configuration, varying the CCT of the white light produced by the luminaire system between about 2950K and about 6500K also varies the luminous flux output of the luminaire system from about 200 lumens at about 2950K to about 330 lumens at about 6500K. In this configuration the overall luminous flux output variation of the luminaire system can be up to about 65%.

In another embodiment of the present invention, the one or more blue light-emitting element light sources of about 455 nm and about 25 nm FWHM with chromaticity coordinates 220 are replaced by one or more blue light-emitting elements of about 480 nm with about 25 nm FWHM having chromaticity coordinates 240. In this embodiment using up to about 120 milliwatts or the equivalent of about 11 lumens of light emitted by the blue light-emitting elements defined by chromaticity coordinate 240 and mixing the above defined warm white light and about 30 milliwatts or the equivalent or about 18 lumens of light emitted by the above defined one or more green light-emitting elements, can change the CCT of light emitted by the luminaire system from about 2950K with about 200 lumens up to about 4100K with about 230 lumens. Therefore in this embodiment about a 15% overall luminous flux output variation of the luminaire system would be realized when varying the CCT of the white light between about 2950K and about 4100K.

In one embodiment of the present invention, the blue and the green light-emitting elements can be selected to have chromaticity values that cam substantially minimize the variation in the overall luminous flux output of the luminaire system across substantially the full CCT range.

In one embodiment, indium gallium nitride (InGaN) material based devices are selected as the material technology for the light sources of this material format can provide substantially the above colour ranges for each colour of light-emitting element. Light-emitting elements within the same material technology can have similar colour and luminous flux output temperature dependence and colour degradation due to ageing, for example, which may simplify the operational control of the light sources. In addition, colour and luminous flux output of InGaN devices are typically less affected by temperature fluctuations than aluminium indium gallium phosphide (AlInGaP) based devices, which may additionally simplify the operational control of the light sources.

Figure 3:
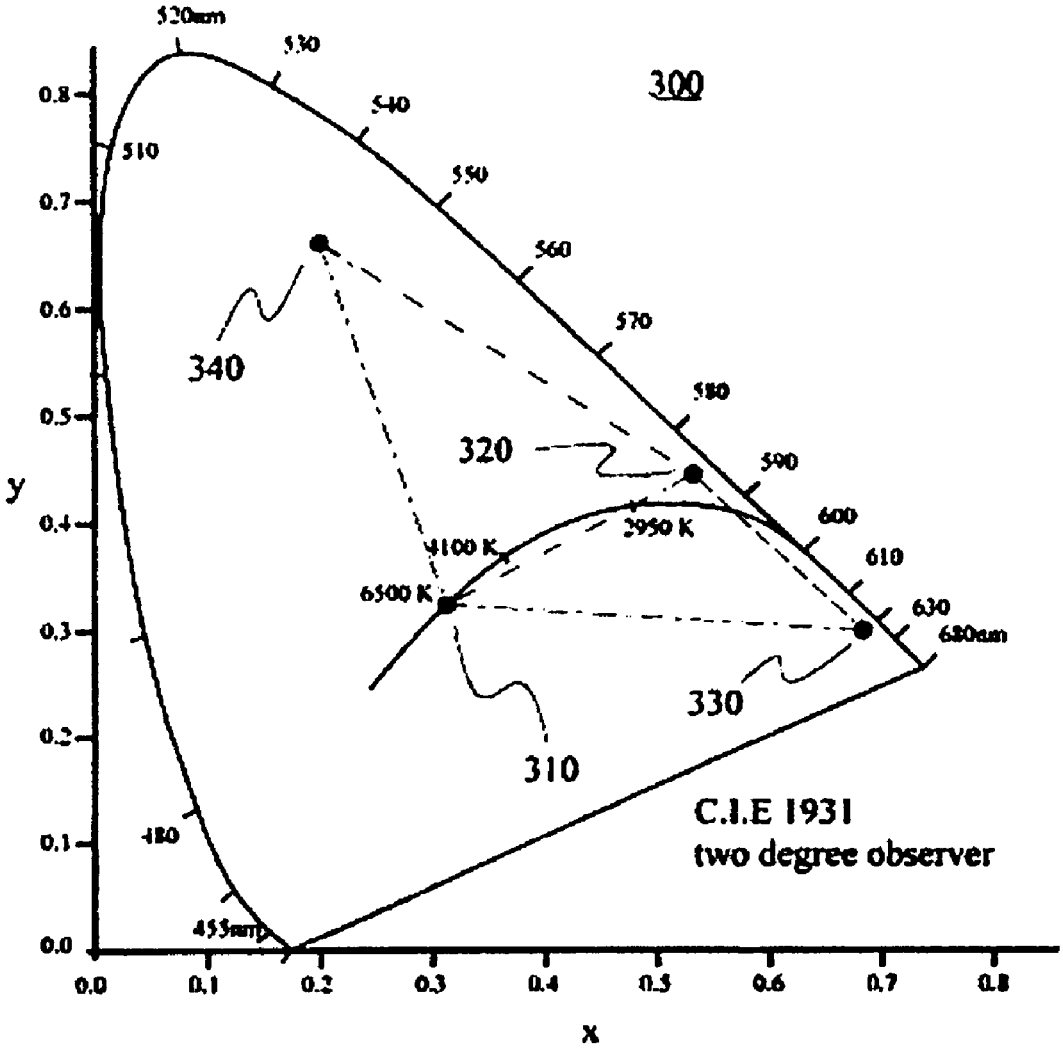
FIG. 3 illustrates the colour gamut and chromaticity diagram for a white light luminaire comprising white, green, and red light-emitting elements according to another embodiment of the present invention.

FIG. 3 illustrates two colour gamuts of a white light luminaire system in chromaticity diagram 300 according to another embodiment of the present invention, wherein the luminaire system comprises three light sources of substantially different chromaticity. The colour gamuts are indicated by the triangular region or polygon region.

In one embodiment of the present invention, the luminaire system comprises light sources including a primary light source of one or more white light-emitting elements of a high CCT, for example, about 4100K or about 6500K with chromaticity coordinates 310. In addition, the luminaire system comprises one or more first colour yellow or amber light-emitting elements, for example, between about 570 nm and about 600 nm center wavelength and a corresponding FWHM having chromaticity coordinate 320. The luminaire system further comprises one or more second colour red light-emitting elements with for example chromaticity coordinate 330. The luminaire system can be capable of creating light having any colour defined by the colour gamut defined by chromaticity coordinates 310, 320 and 330, wherein generation of light along the blackbody locus defined within this colour gamut.

The colour gamut as defined by chromaticity coordinates 310, 320 and 330 may be below the blackbody locus of and therefore in another embodiment of the present invention, the luminaire system further comprises one or more green light-emitting elements. For example, by adding a light source having chromaticity coordinate 340 in the green region thereby including a substantially the entire blackbody locus in the colour gamut of the luminaire system.

Figure 4:
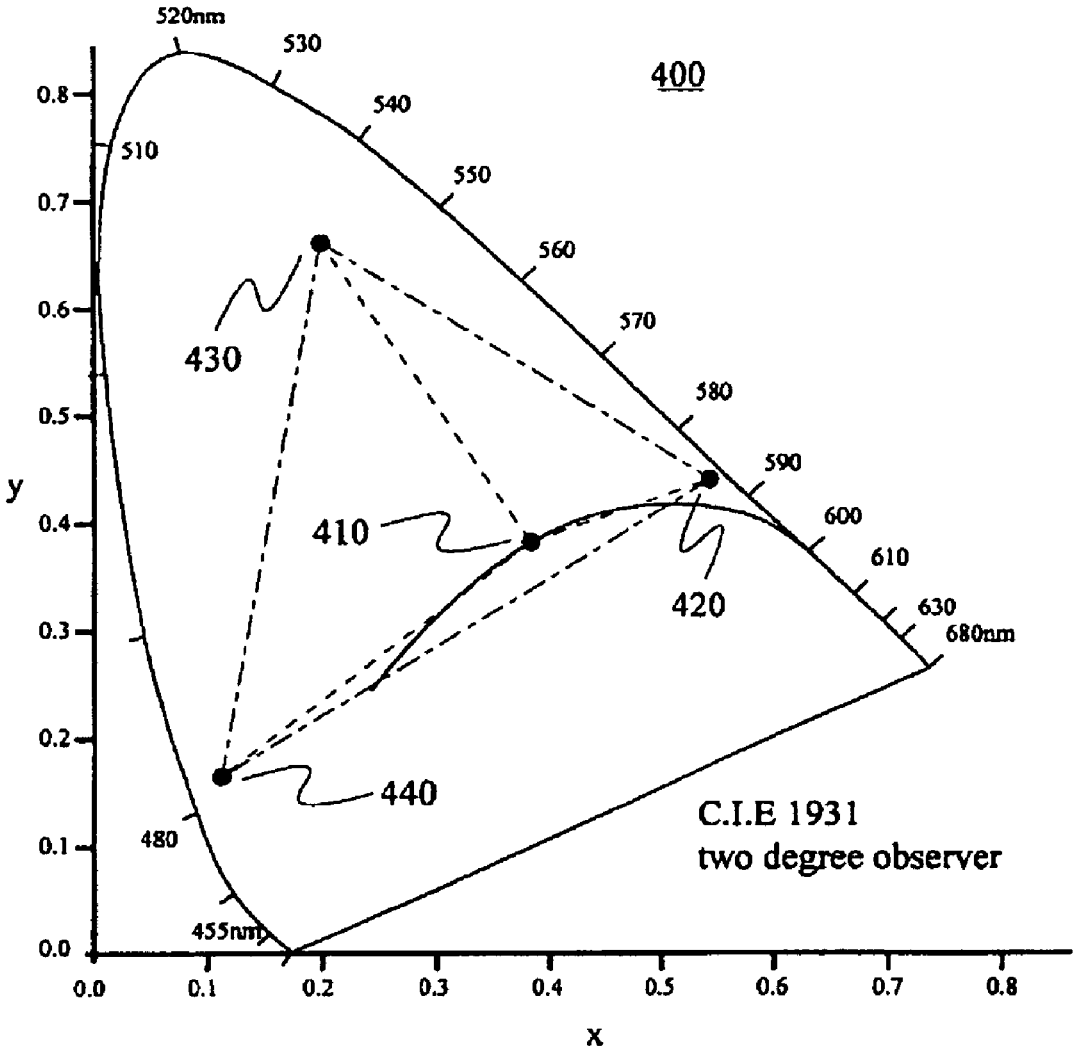
FIG. 4 illustrates the colour gamut and chromaticity diagram for a white light luminaire comprising white, green, blue, and red light-emitting elements according to another embodiment of the present invention.

FIG. 4 illustrates in chromaticity diagram 400 which shows the colour gamut of another white light luminaire system according to another embodiment of the present invention. The luminaire system comprises white light-emitting elements of a medium CCT, for example, about 3500K with chromaticity coordinates 410. In addition, the luminaire system comprises first, second, and third colour light-emitting elements, for example, red to yellow, green, and blue, with respective chromaticity coordinates 420, 430, and 440, respectively. In this embodiment of a white light luminaire system the CCT can be controlled at substantially low luminous flux output variation. The luminaire system can be designed such that mixing the white light with either a first colour red to yellow and a second colour blue an require minimal chromaticity correction in both x and y chromaticity coordinates as well as a substantially minimal additional luminous flux output from the first and second colour light-emitting elements. One or more of each of the first colour red to yellow and the second colour blue light-emitting elements together with the one or more white light-emitting elements may be sufficient to achieve a combined light output of the luminaire system that deviates from the desired CCT within an acceptable tolerance level. A third colour light source, for example one or more green light-emitting elements can be used to correct luminaire system chromaticity values which may otherwise cause an unacceptable deviation from die desired CCT value. In consequence, a control system of the luminaire system with these light sources may require a total of four control channels in order to enable individual control of each of the four different colours of light-emitting elements.

As is known, the CIE defines a number of different observer conditions that can yield to different chromaticity quantifications for the same light spectrum. Even though standard conditions as defined for CIE 1931 are used in the examples, it is understood that the system and method according to the present invention can be based on any other standard observer. It is also understood that systems designed for different CIE standard observers may require light sources with different optical characteristics.

Luminaire System

Figure 5:
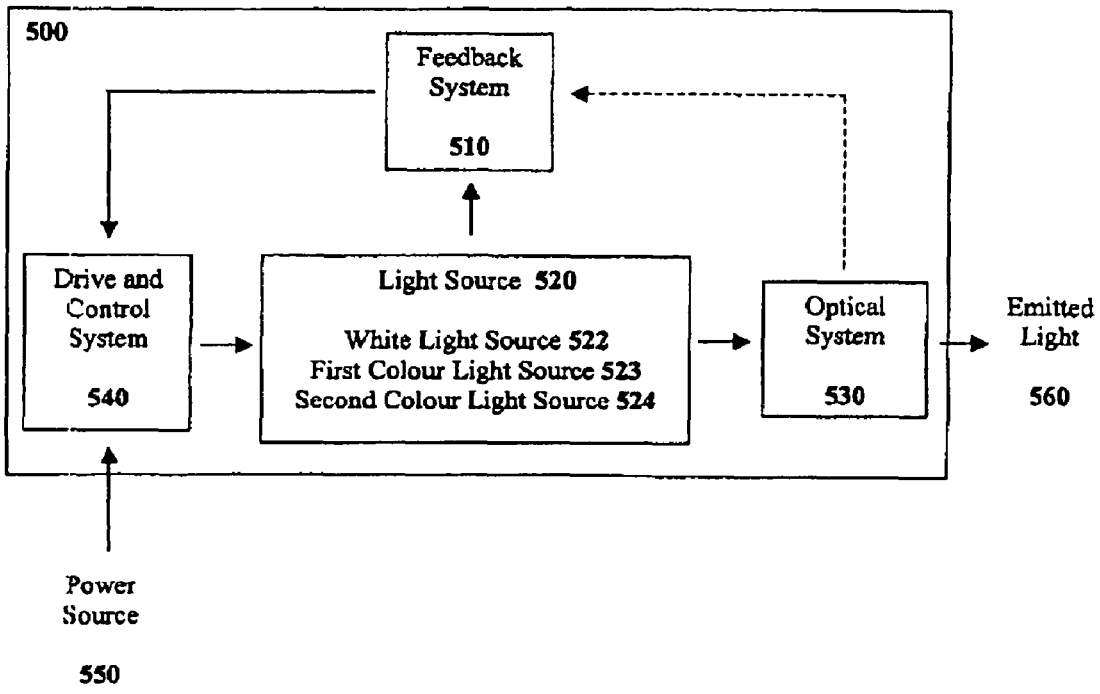
FIG. 5 illustrates a block diagram of a white light luminaire system architecture according to one embodiment of the present invention.
Figure 6A:
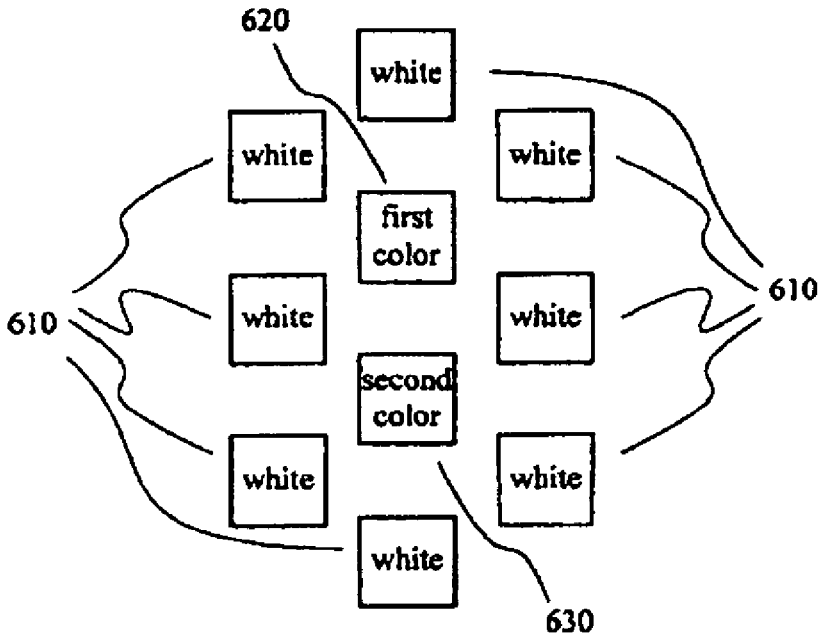
FIG. 6A illustrates an arrangement of an array of light-emitting elements according to one embodiment of the present invention.
Figure 6B:
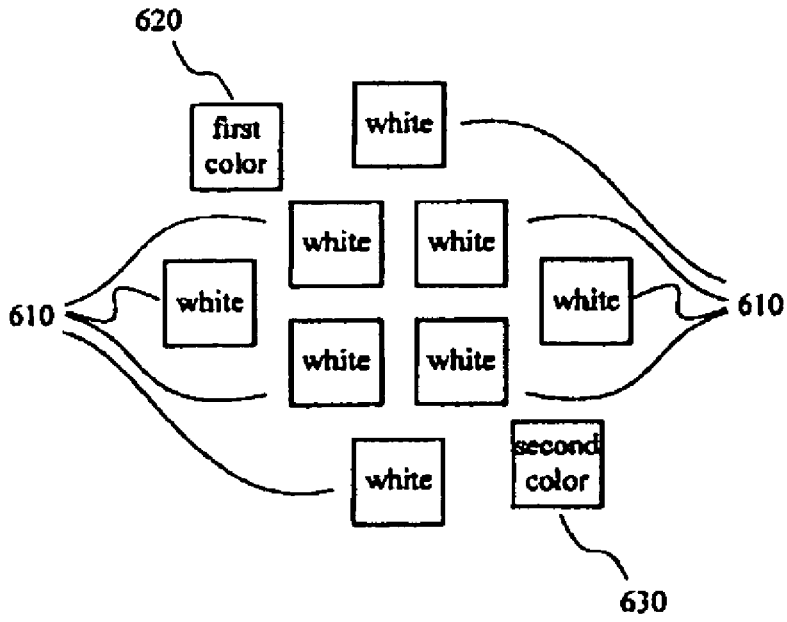
FIG. 6B illustrates an arrangement of an array of light-emitting elements according to another embodiment of the present invention.

FIG. 5 illustrates a block diagram of a white fight luminaire system in accordance with an embodiment of the present invention. The luminaire system 500 comprises a light source 520 including a white light source 522, first colour light source 523 and second colour light source 524. Optionally the light source may comprise a third colour fight source (not shown). Each of the white, first colour and second colour light sources comprise one or more light-emitting elements. A drive and control system 540 receives power from a power source 550 and adjusts the current levels driving the one or more light-emitting elements of each colour in order to achieve a desired correlated colour temperature. The drive and control system is responsive to signals received from a feedback system which collects information relating to the operational characteristics of the light-emitting elements.

In one embodiment the feedback system 510 can optically monitor the luminous flux output as well as the correlated colour temperature of emitted light 560 and this collected information is transmitted to the drive and control system. The feedback system can comprise one or more optical sensors and in the case of multiple optical sensors, each optical sensor can be designed to detect a selected spectral range, for example by using a photodiode with an appropriate optical filter. It is understood that the one or more optical sensors can be any form of optical sensor as would be known to a worker skilled in the art, and not limited to photodiodes.

In one embodiment of the present invention, the feedback system comprises multiple optical sensors, wherein each optical sensor can be configured to collect information relating to predetermined wavelengths of light. For example one optical sensor may collect luminous flux output information in the red wavelength range, a second optical sensor may collect luminous flux output information in the green wavelength range and a third optical sensor may collect luminous flux output information in the blue wavelength range. For this purpose, in one embodiment, each optical sensor is configured as a particular narrow band type optical sensor. In an alternate embodiment each optical sensor is configured as a broadband sensor with an appropriate colour filter associated therewith enabling the separation of luminous flux output into the multiple wavelength ranges. The chromaticity and luminous flux output data regarding the light output of the luminaire system is used by the drive and control system in order to control the activation of the light-emitting elements in order to for the luminaire system to generate white light having a desired CCT.

In another embodiment the feedback system can comprise one or more photodiodes and the drive and control system can periodically or intermittently turn off one or all but one of the colours of light-emitting elements to measure and compute per-colour luminous flux output, total flux output and CCT.

In one embodiment, the feedback system 510 comprises one or more temperature sensors placed in proximity of the light-emitting elements, thereby collecting operational temperatures associated with the light-emitting elements. The temperature information can be fed back to the drive and control system, thereby providing for the modification of the operation of the light-emitting elements based on their operational temperature, if required. For example, the temperature information can provide a means for derating light-emitting elements under high temperature conditions or can be used as to adjust drive levels as a temperature feed forward system. In addition, the collection of information relating to the operational temperatures of the light-emitting elements can provide a means for compensation of the temperature dependences of the light-emitting elements, for example wavelength shifts due to temperature and luminous flux output changes due to temperature.

In one embodiment of the present invention, the feedback system comprises one or more thermal sensors and no optical sensors. The luminaire system chromaticity and luminous flux output is achieved through temperature feed forward control of the light-emitting elements. The thermal characteristics of the light-emitting elements can be stored and accessible to the drive and control system, wherein the thermal characteristics can be stored in a look up table format or can be determined by the use of an approximation algorithm. The temperature dependence of each type of light-emitting element can be provided for accessibility by the drive and control system. For example, the input from the one or more temperature sensors can be used to calculate and or look up and or interpolate the appropriate drive current levels of the each type of light-emitting element for the generation of a desired chromaticity and luminous flux output in order to generate white light of a desired CCT by the luminaire system.

In one embodiment of the present invention, the ageing characteristics of each type of light-emitting element can also be considered in the derivation of the required levels of drive current. For example, for a white light luminaire system according to the present invention, wherein the light sources are based on one material technology, for example InGaN material these light-emitting elements can exhibit similar temperature and ageing dependence characteristics, thereby potentially reducing the required complexity of the drive and control system.

The luminaire system further comprises an optical system 530 that can extract the light from the light-emitting elements and mix the radiation emitted by the light-emitting elements such that illumination over an area with substantial constant CCT can be achieved. The optical system may additionally shape the beam profile of the luminaire. The optical system comprises one or more of refractive optical elements, reflective optical elements, diffractive optical elements, diffusive optical elements or the like for providing the desired type of light manipulation.

In one embodiment of the present invention, the optical system includes optical elements and or features that can sample the output light and direct a portion of the output light towards the optical sensor system, wherein this portion of the output light can be indicative of the luminous flux output level and chromaticity of the light output by the luminaire system.

In one embodiment of the present invention, thermal management system is provided in close contact to the light source, such that heat generated by the light-emitting elements of the light source can be removed therefrom and dissipated. The thermal management system can include but is not limited to: heat pipes, heat sinks, liquid cooled heat sinks or other forms of thermal management systems as would be known to a worker skilled in the art.

FIG. **6*a* illustrates an arrangement of light sources according to one embodiment of the present invention. The arrangement of light sources is configured as a light-emitting element array in which the first 620 and second 630** colour light-emitting elements are positioned in a substantially central relationship to the one or more white light-emitting elements, wherein the white light-emitting elements produce light having a particular CCT.

FIG. **6*b*** illustrates an arrangement of light sources according to another embodiment of the present invention. The arrangement of light sources is configured as a light-emitting element array in which the first and second colour light-emitting elements are positioned in a substantially peripheral relationship to the white light-emitting elements, wherein the white light-emitting elements produce light having a particular CCT. It is understood that an array can comprise any number of white or colour light-emitting elements, as well as any number of light-emitting elements per white or colour. It is also understood, that light-emitting elements can be arranged in any other one, two, or three dimensional geometry. Furthermore, a luminaire system can comprise one or more arrays.

It is obvious that the foregoing embodiments of the invention are exemplary and can be varied in many ways. Such present or future variations are not to be regarded as a departure from the spirit and scope of the invention, and all such modifications as would be obvious to someone skilled in the art are intended to be included within the scope of the following claims.

I claim:

1. A luminaire system configured to generate white light with a desired correlated colour temperature, the luminaire system comprising:

a) a light module including:

i) one or more white light-emitting elements configured to generate a first white light having a particular correlated colour temperature;

ii) one or more first colour light-emitting elements configured to generate light of a first colour;

iii) one or more second colour light-emitting elements configured to generate light of a second colour, wherein the one or more white light-emitting elements are configured to generate the first white light independent of each of the light of the first colour generated by the one or more first colour light-emitting elements and the light of the second colour generated by the one or more second light-emitting elements;

b) a feedback system configured to collect operational temperature information regarding the light module;

c) a drive and control system configured to receive said temperature information, and configured to control the supply of power to each of the one or more white light-emitting elements, the one or more first colour light-emitting elements, and the one or more second colour light-emitting elements based on the temperature information and the desired correlated colour temperature; and d) an optical system configured to extract and mix the light generated by the light module thereby creating an output beam of a second white light having the desired correlated colour temperature, wherein the one or more first colour light-emitting elements and the one or more second colour light-emitting elements are arranged in relationship with the one or more white light-emitting elements to provide the second white light having the desired correlated colour temperature when the light generated by the light module, including the first white light having the particular colour correlated temperature is extracted and mixed.

2. The luminaire system according to claim 1, wherein the feedback system further comprises one or more optical sensors configured to collect optical information relating to light generated by the light module, wherein a drive and control system receives said optical information and further controls the supply of power to each of the one or more white light-emitting elements, the one or more first colour light-emitting elements, and the one or more second colour light-emitting elements based on the optical information.

3. The luminaire system according to claim 2 wherein the light module further comprises one or more third colour light-emitting elements configured to generate light of a third colour.

4. The luminaire system according to claim 3, wherein the first colour light-emitting elements generate green light, the second colour light-emitting elements generate blue light and the third colour light-emitting elements generate red light.

5. The luminaire system according to claim 2, wherein the first colour light-emitting elements generate green light.

6. The luminaire system according to claim 5, wherein the second colour light-emitting elements generate blue or red light.

7. The luminaire system according to claim 2, wherein the white light-emitting elements, first colour light-emitting elements and the second colour light-emitting elements are manufactured using a similar material technology.

8. The luminaire system according to claim 7, wherein the similar material technology is based on indium gallium nitride.

9. The luminaire system according to claim 1, wherein the one or more white light-emitting elements comprises a plurality of white light-emitting elements.

10. The luminaire system according to claim 9, wherein the one or more first colour light-emitting elements and the one or more second colour light-emitting elements are positioned in a substantially central relationship with the plurality of white light-emitting elements to provide the second white light.

11. A method for generating mixed white light, the method comprising:

generating a first coloured light from one or more first colour light-emitting elements; and generating a second coloured light from one or more second colour light-emitting elements;

generating, from one or more white light-emitting elements, a first white light independent of each of the first coloured light and the second coloured light;

mixing the first coloured light, the second coloured light, and the first white light to generate a mixed white light having a desired correlated colour temperature; and arranging the one or more first colour light-emitting elements and the one or more second colour light-emitting elements in relationship with the one or more white light-emitting elements to generate the mixed white light having the desired correlated colour temperature when the first coloured light, the second coloured light, and the first white light are mixed.

12. The method according to claim 11, further comprising the step of generating and mixing in light generated by one or more third colour light-emitting elements.

13. The method according to claim 11, further comprising the step of detecting an operational temperature of the one or more white light-emitting elements, one or more first colour light-emitting elements and one or more second colour light-emitting elements and adjusting operation of the one or more first colour light-emitting elements and one or more second colour light-emitting elements in response to the detected operational temperature.

14. The method according to claim 11, further comprising the step of detecting optical characteristics of the mixed white light and adjusting operation of the one or more first colour light-emitting elements and one or more second colour light-emitting elements in response to the detected optical characteristics.

15. The method according to claim 11, wherein the first colour light-emitting elements generate green light.

16. The method according to claim 15, wherein the second colour light-emitting elements generate blue or red light.

17. The method according to claim 11, wherein the first colour light-emitting elements generate green light, the second colour light-emitting elements generate blue light and the third colour light-emitting elements generate red light.

18. The method according to claim 11, wherein the white light-emitting elements, first colour light-emitting elements and the second colour light-emitting elements are manufactured using a similar material technology.

19. The method according to claim 18, wherein the similar material technology is based on indium gallium nitride.

20. The method according to claim 11, wherein the one or more white light-emitting elements includes a plurality of white light-emitting elements.

21. The method according to claim 20, comprising:

positioning the one or more first colour light-emitting elements and the one or more second colour light-emitting elements in a substantially central relationship with the plurality of white light-emitting elements to generate the mixed white light.

* * * * *